US007399260B1

(12) United States Patent
Chen

(10) Patent No.: US 7,399,260 B1
(45) Date of Patent: Jul. 15, 2008

(54) ANKLE CLAMP ASSEMBLY FOR AN INVERSION TABLE

(75) Inventor: Shi-Lin Chen, Taichung Hsien (TW)

(73) Assignee: Lifegear Taiwan Ltd., Daya Hsiang, Taichung Hsien (TW)

( * ) Notice: Subject to any disclaimer, the term of this patent is extended or adjusted under 35 U.S.C. 154(b) by 0 days.

(21) Appl. No.: 11/737,634

(22) Filed: Apr. 19, 2007

(51) Int. Cl.
*A63B 22/14* (2006.01)

(52) U.S. Cl. ..... 482/145; 482/143; 482/144; 403/109.3

(58) Field of Classification Search ..... 482/143–145; 403/109.3, 109.6, 109.8, 378, 379, 379.1, 403/374.5; 601/23, 27
See application file for complete search history.

(56) References Cited

U.S. PATENT DOCUMENTS 2,310,346 A * 2/1943 Bell ..... 248/408
3,704,850 A * 12/1972 Hendrickson et al. .... 248/188.5
4,531,731 A * 7/1985 Law ..... 482/144
4,534,555 A * 8/1985 McGowen ..... 482/144
6,869,243 B1 * 3/2005 Teeter ..... 403/109.3

* cited by examiner

*Primary Examiner*—Terrell Mckinnon
*Assistant Examiner*—Andrew M Tecco
(74) *Attorney, Agent, or Firm*—patenttm.us

(57) ABSTRACT

An ankle clamp assembly for an inversion table has a stationary frame, an adjustable frame and an operating device. The stationary frame has a longitudinal beam and a transverse beam. The longitudinal beam is connected to the inversion table and has a recess, a latch rod and a mounting arm. The mounting arm is connected to the longitudinal beam and has a stationary latch hole. The adjustable frame is movably connected to the stationary frame and has an adjusting arm and a pressing arm. The adjusting arm extends through the mounting arm and has multiple elongated latch holes. The operating device is connected to the stationary frame, engages the adjustable frame and has a spring, a handle and a latch lever. The latch lever is attached transversely to the handle, extends through the recess into an elongated latch hole corresponding to the stationary latch hole.

8 Claims, 5 Drawing Sheets

ANKLE CLAMP ASSEMBLY FOR AN INVERSION TABLE

BACKGROUND OF THE INVENTION

1. Field of the Invention

The present invention relates to an ankle clamp assembly, and more particularly to an ankle clamp assembly for an invention table, which can be adjusted easily and quickly.

2. Description of Related Art

With reference to FIG. 5, a conventional inversion table (50) holds a person's body to relax or relieve back pain, and has a mounting bracket (51), a table (52) and an ankle clamp assembly (53). The mounting bracket (51) has two connecting plates, a front frame, a rear frame and two folding links. Each connecting plate has multiple mounting holes. The front frame is U-shaped and has two ends. The ends are connected pivotally to the mounting holes respectively in the connecting plates. The rear frame is U-shaped and has two top ends. The top ends are connected securely to the mounting holes respectively in the connecting plates. The folding links are connected between the front and rear frames to hold the mounting bracket (51) in a triangular configuration when the inversion table (50) is in use and allow the front and rear frames to fold together when the inversion table (50) is not being used. The table (52) is attached pivotally between the connecting plates of the mounting bracket (51), holds a person's body before the table (52) is inverted and has a bottom end. The ankle clamp assembly (53) is connected to the bottom end of the table (52) and clamps and holds a person's ankles when the table (52) is pivoted to an inverted position.

However, conventional inversion tables have some shortcomings.

1. The conventional inversion table has many components to form the ankle clamp assembly.

2. The ankle clamp assembly of the conventional inversion table can hold a person's ankles but does not enclose and firmly grasp the person's ankles.

3. The ankle clamp assembly will make manufacturing the invention table more expensive.

The invention provides an ankle clamp assembly for an inversion table that mitigates or obviates the aforementioned problems.

SUMMARY OF THE INVENTION

The main objective of the present invention is to provide an ankle clamp assembly for an inversion table that can be adjusted easily and quickly and securely grasps and holds a person's ankles.

The ankle clamp assembly for an inversion table securely grasps and holds a person's ankles when hanging inverted on an inversion table and has a stationary frame, an adjustable frame and an operating device. The stationary frame has a longitudinal beam and a transverse beam. The longitudinal beam is connected to the inversion table and has a recess, a latch rod and a mounting arm. The mounting arm is connected to the longitudinal beam and has a stationary latch hole. The adjustable frame is movably connected to the stationary frame and has an adjusting arm and a pressing arm. The adjusting arm extends through the mounting arm and has multiple elongated latch holes. The operating device is connected to the stationary frame, engages the adjustable frame and has a spring, a handle and a latch lever. The latch lever is formed obliquely on the handle, extends through the recess and engages an elongated latch hole corresponding to the stationary latch hole.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
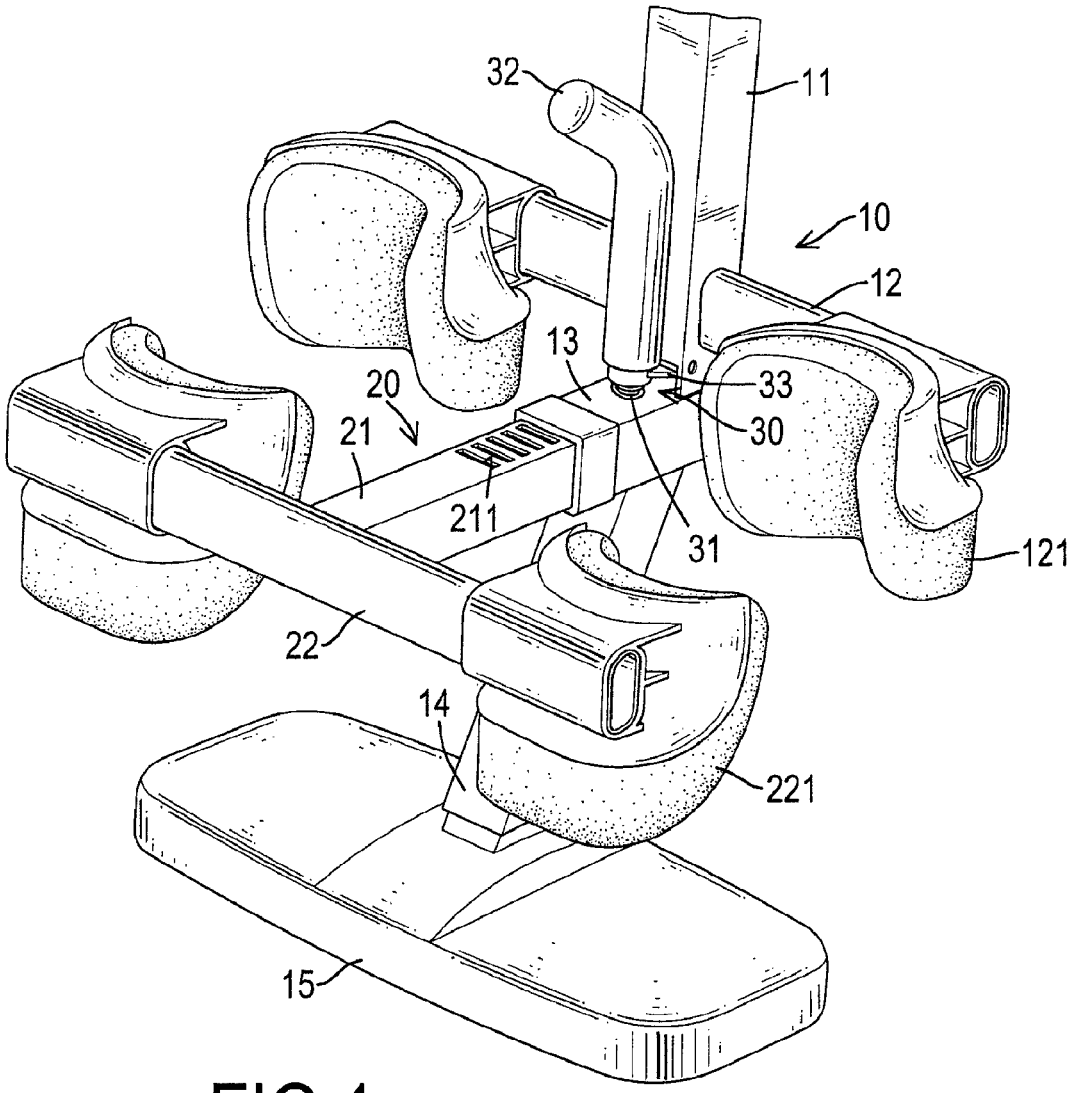
FIG. 1 is a perspective view of an ankle clamp assembly for an inversion table in accordance with the present invention.
Figure 2:
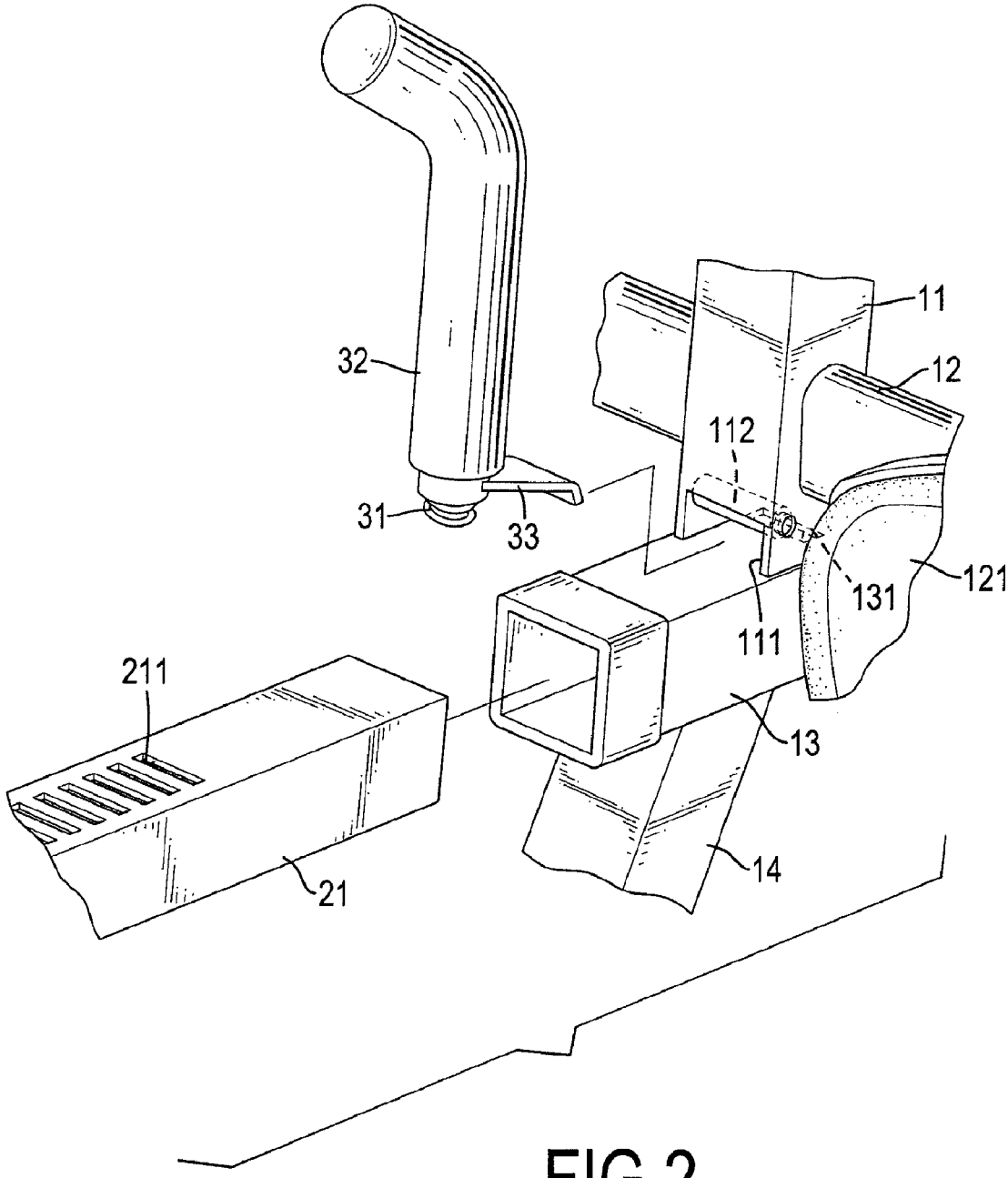
FIG. 2 is an enlarged exploded perspective view of the ankle clamp assembly in FIG. 1.
Figure 3:
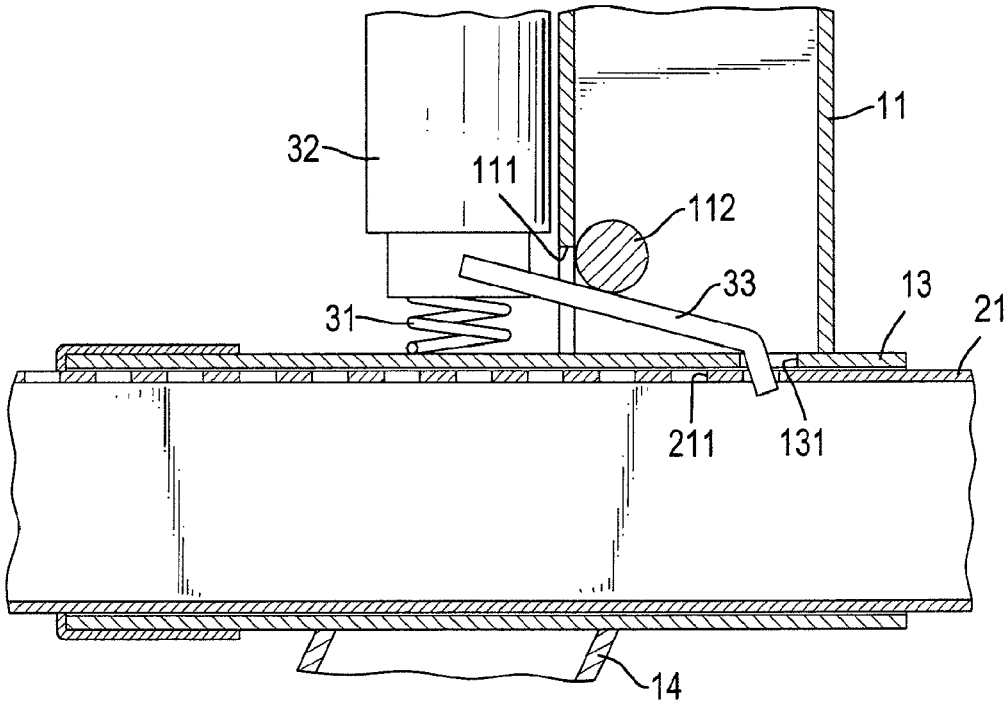
FIG. 3 is an enlarged cross sectional side view of the ankle clamp assembly in FIG. 1.

With reference to FIGS. 1 to 3, an ankle clamp assembly for an inversion table having a table comprises a stationary frame (10), an adjustable frame (20) and an operating device (30).

The stationary frame (10) is connected securely to the table of the inversion table and has a longitudinal beam (11), a transverse beam (12), an optional extension arm (14) and an optional footrest (15).

The longitudinal beam (11) may be tubular and non-circular, is connected securely to the table of the inversion table and has a top end, a bottom end, a front surface, two sidewalls, a chamber, a recess (111), a latch rod (112) and a mounting arm (13). The top end of the longitudinal beam (11) is connected securely to the table of the inversion table. The bottom end of the longitudinal beam (11) is open. The chamber is formed inside the longitudinal beam (11) and communicates with the bottom end. The recess (111) is formed through the front surface of the longitudinal beam (11) at the bottom end and communicates with the chamber. The latch rod (112) is mounted in the chamber of the longitudinal beam (11) transversely between the sidewalls adjacent to the recess (111). The mounting arm (13) is tubular, may be non-circular, is connected to and closes the bottom end of the longitudinal beam (11), extends perpendicularly from the front surface of the longitudinal beam (11) and has a rear end, a front end, a top surface, a bottom surface and a stationary latch hole (131). The rear end of the mounting arm (13) is open. The front end of the mounting arm (13) is open. The top surface of the mounting arm (13) is connected securely to the bottom end of the longitudinal beam (11) near the rear end of the mounting arm (13). The stationary latch hole (131) is formed through the top surface of the mounting arm (13) near the rear end and communicates with the chamber in the longitudinal beam (11).

The transverse beam (12) is mounted through the longitudinal beam (11), protrudes from the sidewalls near the bottom end of the longitudinal beam and has two ends and two stationary cushions (121). The stationary cushions (121) may be U-shaped and are mounted respectively on the ends of the transverse beam (12).

The extension arm (14) is connected to and extends obliquely down from the mounting arm (13) and has a proximal end and a distal end. The proximal end of the extension arm (14) is connected to the bottom surface of the mounting arm (13).

The footrest (15) is connected to the distal end of the extension arm (14) and supports a person's feet.

The adjustable frame (20) is movably connected to the stationary frame (10) and has an adjusting arm (21) and a pressing arm (22).

The adjusting arm (21) may be tubular, may be non-circular, corresponds to and is mounted slidably in the mounting arm (13) and has a proximal end, a distal end, a top surface and multiple elongated latch holes (211). The proximal end of the adjusting arm (21) is mounted through the front end of the mounting arm (13) and protrudes from the rear end of the mounting arm (13). The elongated latch holes (211) are formed through the top surface of the adjusting arm (21) near the proximal end and selectively align and communicate with the stationary latch hole (131) in the mounting arm (13).

The pressing arm (22) is connected transversely to the distal end of the adjusting arm (21), is parallel to the transverse beam (12) of the stationary frame (10) and has two ends and two moveable cushions (221). The moveable cushions (221) are mounted respectively on the ends of the pressing arm (22), correspond to and align with the stationary cushions (121) on the transverse beam (12), securely holds a person's ankles in the stationary cushions (121) on the transverse beam (12) and may be U-shaped.

The operating device (30) allows the moveable cushions (221) on the pressing arm (22) to be moved toward or away from the stationary cushions (121) on the transverse beam (12), holds the pressing arm (22) securely in position, is mounted on the stationary frame (10), engages and latches the adjustable frame (20) and has a spring (31), a handle (32) and a latch lever (33).

The spring (31) is mounted transversely on and protrudes from the top surface of the mounting arm (13) near the recess (111) in the longitudinal beam (11) and has an upper end.

The handle (32) is connected longitudinally to the upper end of the spring (31) and has a proximal end, a distal end and an external surface. The proximal end of the handle (32) is connected longitudinally to the upper end of the spring (31). The distal end of the handle (32) may be curved.

Figure 4:
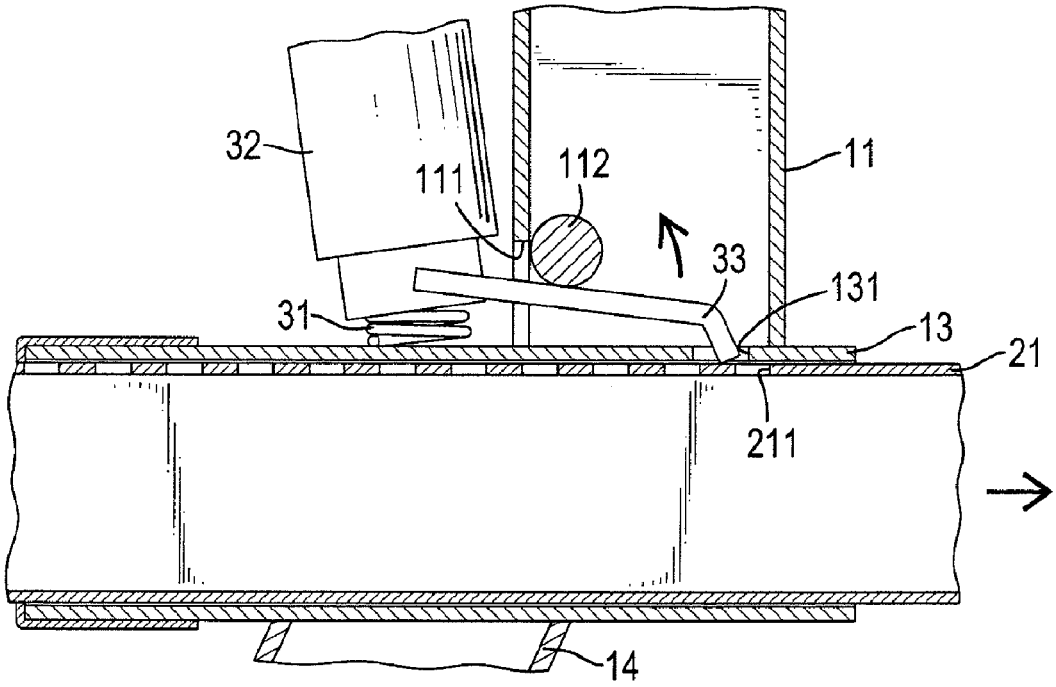
FIG. 4 is an enlarge operational cross sectional side view of the ankle clamp assembly in FIG. 1.
Figure 5:
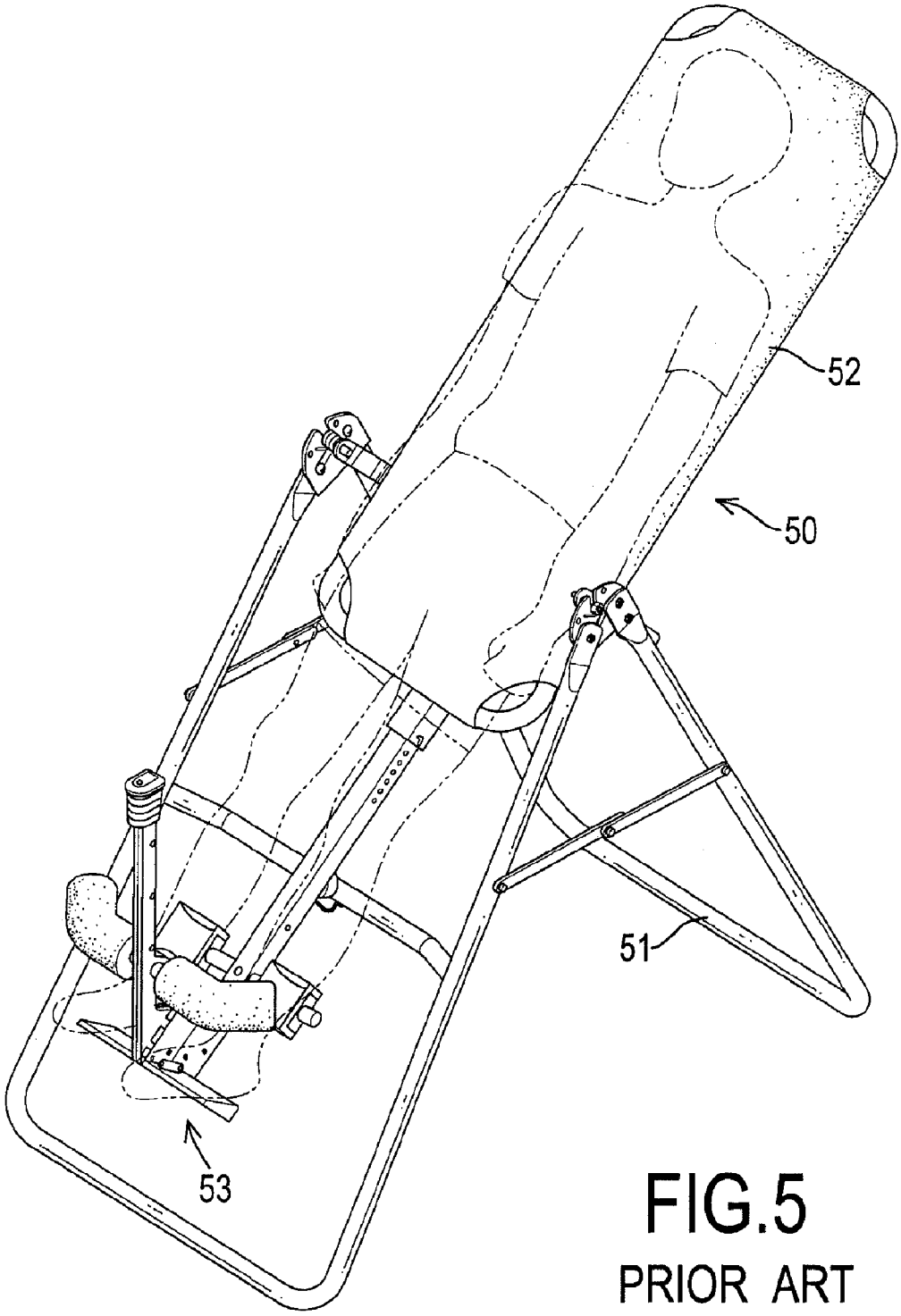
FIG.5 PRIOR ART
FIG. 5 is a perspective view of an inversion table in accordance with the prior art.

The latch lever (33) is connected transversely to and protrudes out and slightly down from the external surface of the handle (32) near the proximal end, extends through the recess (111), presses against the latch rod (112), extends into the stationary latch hole (131) in the mounting arm (13) and a corresponding elongated latch holes (211) in the adjustment arm (21), holds the adjustable frame (20) in position relative to the stationary frame (10) and has a proximal end, a distal end and a latch lip. The latch lip is formed on the distal end of the latch lever (33), is mounted in the stationary latch hole (131) in the mounting arm (13) and extends into an elongated latch hole (211) that is aligned with the stationary latch hole (131) to hold the adjustable frame (20) in position relative to the stationary frame (10). With a further reference to FIGS. 3 and 4, the latch lip of the latch lever (33) is released from the stationary latch hole (131) by pressing the handle (32) down and toward the pressing arm (22) on the adjustable frame (20) so moveable cushions (221) can be moved toward the stationary cushions (121) to securely clamp a person's ankles or away from the stationary cushions (121) to release a person's ankles.

The ankle clamp assembly for an inversion table as described has the following advantages:

1. The stationary frame (10), the adjustable frame (20) and the operating device (30) provide a simple structure for the ankle clamp assembly.

2. The ankle clamp assembly for the inversion table can grasp a person's ankles with the stationary cushions (121) and the moveable cushions (221) easily and quickly by simply pressing and tilting the handle (32).

3. The cost of manufacturing the inversion table can be reduced by the simple components of the ankle clamp assembly.

Even through numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An ankle clamp assembly for an inversion table having a table, the ankle clamp assembly comprising:

a stationary frame being adapted to be connected securely to the table of the inversion table and having a longitudinal beam being adapted to be connected securely to the table of the inversion table and having a top end being adapted to be connect securely to the table of the inversion table;

a bottom end being open;

a front surface;

two sidewalls;

a chamber being formed inside the longitudinal beam and communicating with the bottom end;

a recess being formed through the front surface of the longitudinal beam at the bottom end and communicating with the chamber;

a latch rod being mounted in the chamber transversely between the sidewalls adjacent to the recess; and a mounting arm being tubular, being connected to and closing the bottom end of the longitudinal beam, extending perpendicularly from the front surface of the longitudinal beam and having a rear end being open;

a front end being open;

a top surface connected securely to the bottom end of the longitudinal beam near the rear end;

a bottom surface; and a stationary latch hole being formed through the top surface of the mounting arm near the rear end and communicating with the chamber in the longitudinal beam; and a transverse beam being mounted through the longitudinal beam, protruding from the sidewalls near the bottom end and having two ends; and two stationary cushions being mounted respectively on the ends of the transverse beam;

an adjustable frame being movably connected to the stationary frame and having an adjusting arm corresponding to and being mounted slidably the mounting arm and having a proximal end being mounted through the front end of the mounting arm and protruding from the rear end of the mounting arm;

a proximal end;

a top surface; and a multiple elongated latch holes being formed through the top surface of the adjusting arm near the proximal end and selectively aligning and communicating with the stationary latch hole in the mounting arm; and a pressing arm being connected transversely to the distal end of the adjusting arm, being parallel to the transverse beam of the stationary frame and having two ends; and two moveable cushions being mounted respectively on the ends of the pressing arm and corresponding to the stationary cushions on the transverse beam to securely hold a person's ankles in the stationary cushions on the transverse beam; and an operating device allowing the moveable cushions on the pressing arm to be moved toward or away from the stationary cushions on the transverse beam, holding the pressing arm securely in position, being mounted on the stationary frame, engaging and latching the adjustable frame and having a spring being mounted transversely on an protruding from the top surface of the mounting arm near the recess in the longitudinal beam and having an upper end;

a handle being connected longitudinally to the upper end of the spring and having a proximal end being connected longitudinally to the upper end of the spring;

a distal end; and an external surface; and a latch lever being connected transversely to and protruding out and slightly down from the external surface of the handle near the proximal end, extending through the recess, pressing against the latch rod, extending into the stationary latch hole in the mounting arm and a corresponding elongated latch hole in the adjust arm, holding the adjustable frame in position relative to the stationary frame and having a proximal end;

a distal end; and a latch lip being formed on the distal end of the latch lever, being mounted in the stationary latch hole in the mounting arm and extending into an elongated latch hole that is aligned with the stationary latch hole.

2. The ankle clamp assembly for an inversion table as claimed in claim 1, wherein the stationary frame further has an extension arm being connected to and extending obliquely down from the mounting and having an proximal end being connected to the bottom surface of the mounting arm; and a distal end; and a footrest being connected to the distal end of the extension arm.

3. The ankle clamp assembly for an inversion table as claimed in claim 1, wherein the mounting arm is non-circular; and the adjusting arm is non-circular.

4. The ankle clamp assembly for an inversion table as claimed in claim 1, wherein the stationary cushions are U-shaped; and the moveable cushions are U-shaped.

5. The ankle clamp assembly for an inversion table as claimed in claim 1, wherein the longitudinal beam is tubular; and the adjusting arm is tubular.

6. The ankle clamp assembly for an inversion table as claimed in claim 1, wherein the distal end of the handle is curved.

7. The ankle clamp assembly for an inversion table as claimed in claim 2, wherein the mounting arm is non-circular; and the adjusting arm is non-circular.

8. The ankle clamp assembly for an inversion table as claimed in claim 7, wherein the stationary cushions are U-shaped; and the moveable cushions are U-shaped.

* * * * *